US006761801B2

(12) United States Patent
Ruf et al.

(10) Patent No.: US 6,761,801 B2
(45) Date of Patent: Jul. 13, 2004

(54) LAMELLA OF A HEADBOX OF A PAPER, CARDBOARD, OR TISSUE MACHINE

(75) Inventors: Wolfgang Ruf, Herbrechtingen (DE); Hans Loser, Langenau (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/978,041

(22) Filed: Oct. 17, 2001

(65) Prior Publication Data

US 2002/0043355 A1 Apr. 18, 2002

(30) Foreign Application Priority Data

Oct. 18, 2000 (DE) ..... 100 51 802

(51) Int. Cl.[7] ..... D21F 1/02
(52) U.S. Cl. ..... 162/336; 162/343; 162/298
(58) Field of Search ..... 162/216, 336–343, 162/123, 298

(56) References Cited

U.S. PATENT DOCUMENTS 4,566,945 A * 1/1986 Ewald et al. ..... 162/343
4,617,091 A * 10/1986 Rodal et al. ..... 162/343
4,941,950 A * 7/1990 Sanford ..... 162/343
5,545,294 A * 8/1996 Linden et al. ..... 162/343
5,553,381 A * 9/1996 Lehtonen ..... 29/895.32
5,639,352 A 6/1997 Ruf et al. ..... 162/343
5,645,689 A * 7/1997 Ruf et al. ..... 162/343
5,707,495 A 1/1998 Heinzmann et al. ..... 162/343
5,820,734 A * 10/1998 Pantaleo et al. ..... 162/343
5,849,159 A 12/1998 Heinzmann et al.
5,885,420 A 3/1999 Heinzmann et al. ..... 162/198
5,902,642 A * 5/1999 Horiki et al. ..... 427/282

FOREIGN PATENT DOCUMENTS

| | | |
|---|---|---|
| DE | 4019593 | 1/1992 |
| DE | 4329810 | 6/1994 |
| EP | 147350 | 7/1985 |
| EP | 0681057 | 11/1995 |
| WO | 98/51856 | 11/1998 |

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

Lamella and headbox of a web production machine. The lamella is formed of at least one high-performance polymer. The at least one high-performance polymer includes high stability, high heat resistance, and good to very good resistance to at least one of alkaline solution and acid. The headbox includes the lamella.

62 Claims, 3 Drawing Sheets

LAMELLA OF A HEADBOX OF A PAPER, CARDBOARD, OR TISSUE MACHINE

CROSS-REFERENCE TO RELATED APPLICATIONS

The present application claims priority under 35 U.S.C. § 119 of German Patent Application No. 100 51 802.2, filed on Oct. 18, 2000, the disclosure of which is expressly incorporated by reference herein in its entirety.

BACKGROUND OF THE INVENTION

1. Field of the Invention

The present invention relates to a lamella of a headbox in, e.g., a paper, cardboard or tissue machine.

2. Discussion of Background Information

A lamella of a multi-layered headbox is known to the Applicant from European Patent Application No. EP 0 681 057 A2. In the nozzle of the disclosed headbox, at least one lamella is provided, which maintains the distance of two adjacent suspension flows down to a region of an exit nip. The lamella is formed of plastic with its modulus of elasticity preferably being smaller than about 80,000 N/mm$^2$.

As is generally known, the plastic can be a polycarbonate (PC) which has been extremely successful as a material for many modern and technically demanding applications due to its specific characteristics. For example, the high-tech polycarbonate by the company Bayer AG with the trade name Makrolon®, and that of General Electric with the trade name Lexan®, have a global reputation.

The polycarbonate is used for inexpensive lamellae of applications in which the use of expensive lamellae is impossible or not suitable for economic reasons, e.g., in one-layered headboxes in which the lamellae end within the nozzle.

When polycarbonate is used as the material for lamellae, it is disadvantageous that the connection between the lamella and the headbox (or turbulence generator) must be constructed larger than sometimes desired due to the low stability of the polycarbonate. Additionally, polycarbonate has mechanical, chemical, thermal, and processing disadvantages as well.

Carbon fiber composite materials are better, yet also more expensive materials for lamellae, by which lamellae are produced in several components. The carbon fiber composite materials are particularly suitable in applications with very high requirements concerning shape stability and constancy of the crosswise thickness profile of the streams, in particular in multi-layered headboxes.

Until now, all materials known and used for lamellae for use in headboxes for producing a material web, such as a paper or cardboard web, by at least one fibrous stock suspension, have had in common the fact that they render the lamellae sensitive to the influence of mechanical forces, such as, e.g., during handling. Furthermore, they have a low resistance to high temperatures and alkaline solutions during cleaning of the headbox by "boil out." Additionally, the service life of the lamellae is reduced due to the cited properties of the materials mentioned above.

SUMMARY OF THE INVENTION

Therefore, the present invention provides a headbox of the type generally discussed at the outset in which a lamella is provided with a better expense/effectiveness ratio for all possible utilizations and better withstands different operating conditions.

Accordingly, the present invention is directed to a headbox that includes a lamella constructed of at least one high-performance polymer, having high stability, high heat resistance, and good to very good resistance to alkaline solutions and/or acids.

High-performance polymers belong to the thermoplastic plastics, called "thermoplastics," for short, and are characterized by a very high maximum operational temperature according to UL 746 B (U.S. testing regulations of the Underwriters' Laboratories) and/or IEC 216, among other things, being in the range of about 160° C. to about 260° C., i.e., which exhibits a very good heat resistance, a good to very good resistance to alkaline solutions, and increased stability values.

Due to these characteristics (mechanic, thermal, and chemical), mentioned as examples, high-performance polymers are quite optimally suitable for use as the material for lamellae. They have an improved expense/effectiveness ratio and are able to withstand worsened operating conditions for longer.

In order to increase the mechanical characteristics of the lamella and to reduce its sensitivity to the influence of mechanical forces, the high-performance polymer has a tensile strength $R_m$ (DIN 53455) in the range of about 50 N/mm$^2$ to about 150 N/mm$^2$, preferably about 70 N/mm$^2$ to about 110 N/mm$^2$, and a breaking elongation $A_s$ (DIN 53455) in the range of about 20% to about 80%) preferably about 30% to about 60%. Furthermore, the high-performance polymer has a modulus of elasticity module E (DIN 53457, ISO 527-2) in the range of about 500 N/mm$^2$ to about 10,000 N/mm$^2$, preferably about 1,000 N/mm$^2$ to about 5,000 N/mm$^2$.

The connection between the lamella and the turbulence generator may be constructed in a smaller fashion, if the high-performance polymer has an impact strength when notched (ISO 179) of about 40 kJ/m$^2$ to about 100 kJ/m$^2$, preferably about 45 kJ/m$^2$ to about 90 kJ/m$^2$.

The behavior of the lamella concerning moisture and water (hydrolysis resistance) is decisively improved if the high-performance polymer has a moisture acceptance FA (ISO 62) in the range of about 0.05% to about 2%, preferably about 0.2% to about 12%.

In order to allow an efficient and inexpensive cleaning of a lamella, the high-performance polymer has a heat resistance WB (DIN 53461) in the range of about 120° C. to about 230° C., preferably about 170° C. to about 220° C., and a good to very good resistance to alkaline solutions. With these values, the performance of cleaning the headbox by "boil out" is possible, i.e., the presence of temperatures in the range of about 100° C. and, simultaneously, the use of sodium hydroxide (NaOH) of about 20%.

In order to ensure the dimensional stability even during operation, the high-performance polymer has a low swelling Q, in particular, a low linear swelling $Q_L$, in the preferred range of about 0.02% to about 0.2%.

Out of the group of high-performance polymers that perform the above-mentioned requirements during operation and during cleaning of the headbox in an excellent fashion, polyphenylene sulphone (PPSU), polyether sulphone (PES), polyetherimide (PEI), and polysulphone (PSU) are recommended. The first three mentioned high-performance polymers, which were not developed until most recently, exhibit water absorption characteristics (DIN 53495) of 1.10% for PPSU; 2.00% for PES and 1.25% for PEI and heat resistance (DIN 53461) of 214° C. for PPSU; 214° C. for PES and 200° C. for PEI, which are superior to those of PSU, i.e., 0.8% for DIN 53495 and 181° C. for DIN 53461.

Depending on the use in question, the lamella reaching to the region of the nozzle may, on its structure less end region viewed in the flow direction, have a dull lamella end having a height less than about 0.4 mm, preferably less than about 0.3 mm, or have on its structured end region viewed in the flow direction, a dull lamella end having a height of more than about 0.5 mm. In another embodiment, a structured end region can be provided with a grooved structure having a rectangular and/or wedge-like and/or parabolic and/or round shape with a constant and/or varying depth.

In an advantageous embodiment, the lamella is completely constructed of one high-performance polymer in a homogenous design; in an alternative embodiment, the lamella end only is formed from at least one high-performance polymer. Thus, both embodiments ensure that at least the critical region of the lamella, i.e., the lamella end in the preferred embodiment of a lamella tip, has the advantageous characteristics of the high-performance polymer.

Furthermore, the lamella according to the invention may be embodied in a headbox with sectioned stock density control (dilution water technology). In this embodiment of the headbox, the possibility is created of allowing the sectional control of throughput, stock density, and, thus, basis weight and orientation of the fibers in the presence of the optimized lamellae.

In order to take into account present and future requirements of production with regard to the production amount, the headbox may be designed for a flow speed greater than about 1,500 m/s, preferably greater than about 1,800 m/s.

The lamella may also be integrated in a headbox embodied as a multi-layered headbox with the lamella essentially having the above-mentioned characteristics, embodied as a separating lamella of a multi-layered headbox.

It must be understood that the characteristics of the invention mentioned above and to be explained below can be used not only in the combinations mentioned, but also in different combinations or alone without departing from the scope of the invention.

The present invention is directed a lamella positionable in a headbox of a web production machine. The lamella is formed of at least one high-performance polymer; and the at least one high-performance polymer may include high stability, high heat resistance, and good to very good resistance to at least one of alkaline solution and acid.

In accordance with a feature of the present invention, the web production machine can include one of a paper, cardboard and tissue machine.

The high-performance polymer may have a tensile strength $R_m$ (DIN 53455) in the range of about 50 N/mm$^2$ to about 150 N/mm$^2$, and a breaking elongation $A_s$ (DIN 53455) in the range of about 20% to about 80%. The tensile strength $R_m$ can be in a range of about 70 N/mm$^2$ to about 110 N/mm$^2$, and the breaking elongation $A_s$ is in a range of about 30% to 60%.

The high-performance polymer can have a modulus of elasticity E (DIN 53457, ISO 527-2) in a range of about 500 N/mm$^2$ to about 10,000 N/mm$^2$. The modulus of elasticity E can be in a range of about 1,000 N/mm$^2$ to about 5,000 N/mm$^2$.

The high-performance polymer may have an impact strength when notched (ISO 179) of about 40 kJ/m$^2$ to about 100 kJ/m$^2$. The impact strength can be in a range of about 45 kJ/m$^2$ to about 90 kJ/m$^2$.

The high-performance polymer can have a moisture acceptance FA (ISO 62) in the range of about 0.05% to about 2%. The moisture acceptance FA may be in a range of about 0.2% to about 1.2%.

The high-performance polymer may have a heat resistance WB (DIN 53461) in the range of about 120° C. to about 230° C. The heat resistance WB can be in a range of about 170° C. to about 220° C.

The high-performance polymer may have a low swelling Q in a range of about 0.02% to about 0.2%. The low swelling Q can be a low linear swelling $Q_L$.

According to another feature of the invention, the high-performance polymer comprises at least one of polyphenylene sulphone (PPSU), polyether sulphone (PES), polyetherimide (PEI), and polysulphone (PSU).

Further, the headbox can include a nozzle, and the lamella may include a free end arranged to extend to a region of the nozzle. The free end may include an structure less end region with a dull lamella end having a height less than about 0.4 mm. The height of the dull lamella end can be less than about 0.3 mm.

According to still another feature of the present invention, the headbox can include a nozzle, and the lamella may include a free end arranged to extend to a region of the nozzle. The free end may include a structured end region with a dull lamella end having a height of more than about 0.5 mm. The structured end region can include grooves having at least one of (A) at least one of essentially rectangular, wedge-shaped, parabolic, and essentially round structure, and (B) varying depth. At least the lamella end can be constructed of the at least one high-performance polymer.

The lamella may be constructed of the high-performance polymer in a homogenous structure.

Further, the headbox may include a sectioned fiber suspension density control (dilution control).

According to another feature of the instant invention, the headbox can be designed for a flow speed greater than about 1,500 m/s, and preferably the flow speed may be greater than about 1,800 m/s.

Moreover, the lamella can be arranged as a separating lamella in a multi-layered headbox.

In accordance with still another feature of the invention, the lamella can be provided in combination with a headbox with a sectioned fiber suspension density control. The lamella may be located within the headbox.

Further, the lamella may be in combination with a headbox designed for a jet speed greater than about 1,500 m/s, and, preferably, the jet speed is greater than about 1,800 m/s.

In accordance with still yet another feature of the present invention, the lamella may be in combination with a multi-layered headbox. The lamella can be integrated into the multi-layered headbox as a separating lamella.

According to yet another feature of the instant invention, the web production machine can include one of a paper, cardboard, and tissue machine.

The present invention is directed to a headbox of a web production machine. The headbox includes a lamella formed of at least one high-performance polymer. The at least one high-performance polymer includes high stability, high heat resistance, and good to very good resistance to at least one of alkaline solution and acid Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
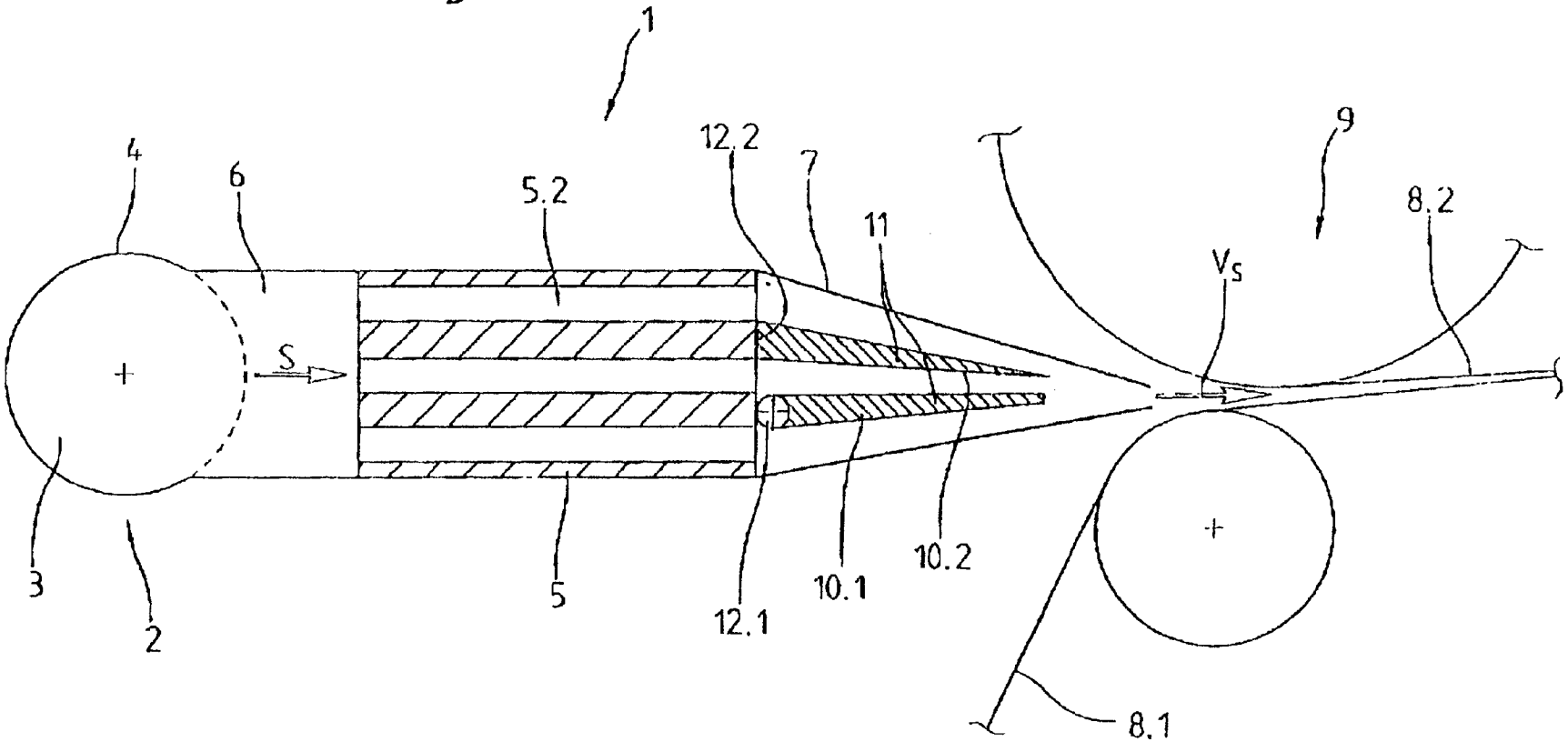
FIG. 1 schematically illustrates a longitudinal sectional view of a headbox having two lamellae according to the invention.

FIG. 1 schematically illustrates a sectional view of a headbox 1, which includes a feeding device 2 for feeding a fibrous stock suspension 3. Feeding device 2 is embodied or formed as a crosswise dispersing pipe 4, however, it may include a central disperser having feeding pipes as well. Headbox 1 is further provided with a device for producing micro-turbulences (i.e., a "turbulence generator") 5 across a width of the machine) with a pre-chamber 6 arranged across the width of the machine, and arranged upstream, relative to a flow direction S (arrow), of the fibrous stock suspension 3. Accordingly, turbulence generator 5 can include a multitude of lines and columns next to one another and variously structured turbulence pipes 5.2 positioned above one another. In flow direction S (arrow) of fibrous stock suspension 3 downstream from turbulence generator 5, a nozzle 7 across the width of the machine is provided for dispersing fibrous stock suspension 3 between two wires (i.e., lower wire 8.1, upper wire 8.2) of a gap former 9, which is not shown in greater detail. In another embodiment, fibrous stock suspension 3 may be dispersed onto only one wire of a continuous wire or hybrid former. Two lamellae 10.1 and 10.2 across the width of the machine are provided in nozzle 7 of headbox 1.

According to the invention, the two lamellae 10.1 and 10.2 are constructed of at least one high-performance polymer 11, have high stability, high heat resistance, and good to very good resistance to alkaline solutions and/or acids.

High-performance polymer 11 has a tensile strength $R_m$ (DIN 53455) in the range of about 50 N/mm$^2$ to about 150 N/mm$^2$, preferably about 70 N/mm$^2$ to about 110 N/mm$^2$, and a breaking elongation $A_s$ (DIN 53455) in the range of about 20% to about 80%, preferably about 30% to about 60%. Furthermore, high-performance polymer 11 has a modulus of elasticity E (DIN 53457, ISO 527-2) in the range of about 500 N/mm$^2$ to about 10,000 N/mm$^2$, preferably about 1,000 N/mm$^2$ to about 5,000 N/mm$^2$.

Moreover, high-performance polymer 11 has an impact strength when notched (ISO 179) of about 40 kJ/m$^2$ to about 100 kJ/m$^2$, preferably about 45 kJ/m$^2$ to about 90 kJ/m$^2$, in order to allow the connection of lamellae 10.1 and 10.2 to turbulence generator 5 to be constructed in a smaller fashion.

In order to decisively improve the properties of lamellae 10.1 and 10.2 regarding moisture and water (hydrolysis resistance), high-performance polymer 11 has a moisture acceptance FA (ISO 62) in the range of about 0.05% to about 2%, preferably about 0.2% to about 1.2%.

Under the aspect of cleaning technology, high-performance polymer 11 of lamellae 10.1 and 10.2 has a heat resistance WB (DIN 59461) in the range of about 120° C. to about 230° C., preferably about 170° C. to about 220° C., and a good to very good resistance to alkaline solution, because having these values the performance of the cleaning of headbox 1 is possible by "boil out", i.e., the presence of temperatures in the range of about 100° C. and, simultaneously, the use of sodium hydroxide (NaOH) of about 20%.

In order to ensure the dimensional stability of lamellae 10.1 and 10.2 during operation as well, high-performance polymer 11 has a low swelling Q, in particular a low linear swelling $Q_L$, preferably in the range of about 0.02% to about 0.2%.

Polyphenylene sulphone (PPSU), polyether sulphone (PES), polyetherimide (PEI), and polysulphone (PST), which perform the given tasks in operation and during cleaning of a headbox in an excellent fashion are recommended among the group of high-performance polymers 11.

Advantageously, lamellae 10.1 and 10.2 are constructed in a homogenous design made from one high-performance polymer each. The use of different high-performance polymers is certainly possible as well.

Furthermore, it is discernible from FIG. 1 that lamella 10.1, provided with a dull lamella end, is jointedly mounted at its end 12.1 to turbulence generator 5 and lamella 10.2, provided with a sharp lamella end, is mounted in as stationary manner to turbulence generator 5 by its end 12.2. However, in another embodiment the mounted lamella ends may be positioned in turbulence generator 5 as well, i.e., between two respective rows of turbulence pipes 5.2.

In order to take into account present and future requirements of production with regard to the production amount and the like, headbox 1 is designed for jet speeds $v_s$ (arrow) greater than about 1,500 m/s, preferably greater than about 1,800 m/s, considering aspects of hydraulics and flow technology.

Figure 2:
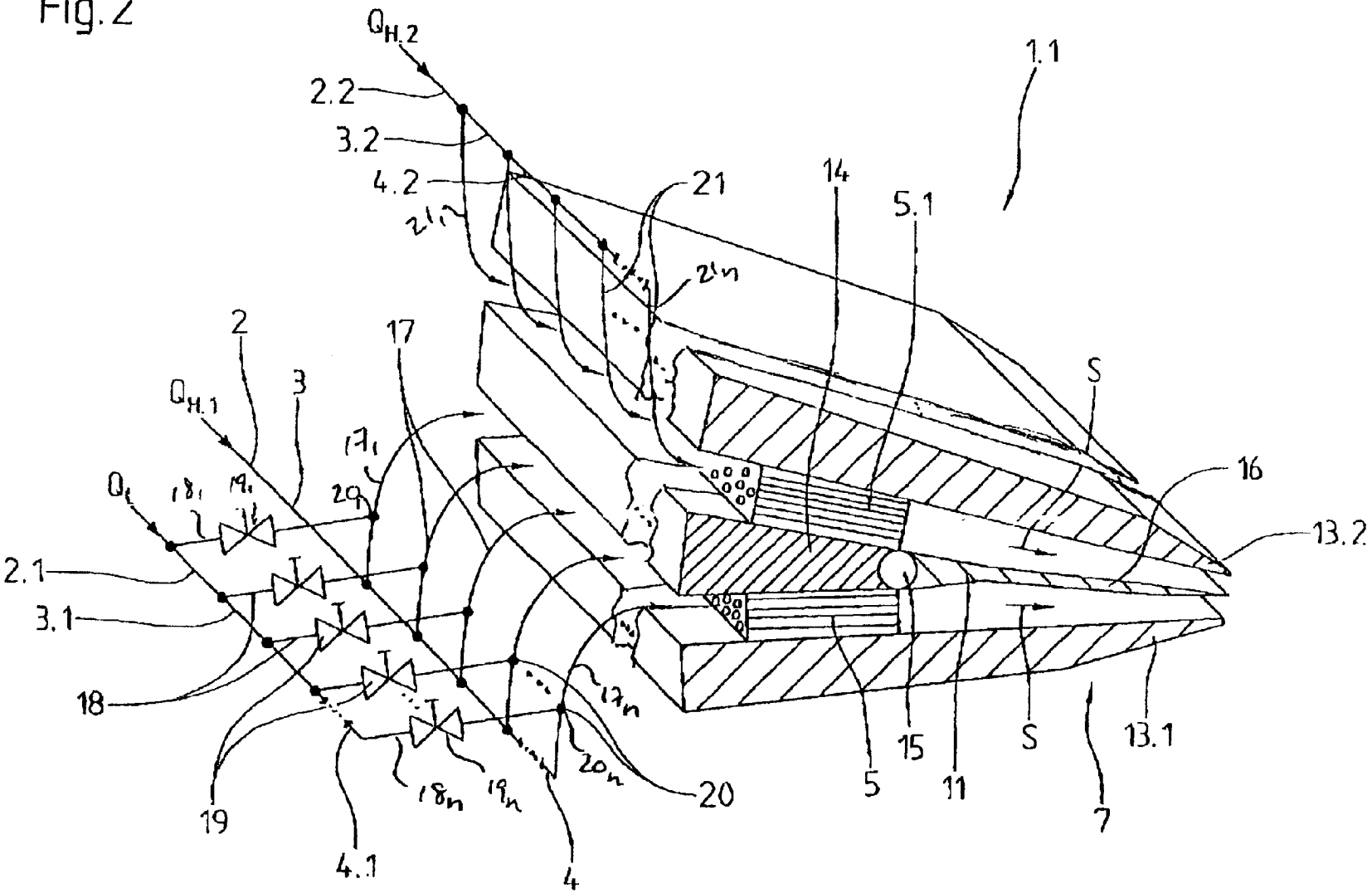
FIG. 2 schematically illustrates a perspective view of a multi-layered headbox having a lamella according to the invention.

The schematic perspective view of FIG. 2 shows a headbox embodied or formed as a multi-layered headbox 1.1 having feeding devices 2, 2.1, 2.2, which are only schematically shown, for introducing different fibrous stock suspensions 3, 3.1, 3.2. Nozzle 7 is limited in a known fashion by two flow guidance walls 13.1, 13.2 over the width of the machine. These walls are each connected to a central, stationary separation wall 14 by a known turbulence generator 5, 5.1. A separating lamella 16 is pivotally mounted on the distributing end of separating wall 14 by a joint 15. Alternatively, separating lamella 16 may also be mounted in a stationary manner relative to separating wall 14.

According to the invention, multi-layered headbox 1.1 is embodied or formed as a headbox having a sectioned fibrous suspension density control (dilution water technology) as disclosed in German publication DE 40 19 593 A1, U.S. Pat. No. 5,707,495, and U.S. Pat. No. 5,885,420 of the Applicant, the disclosures of which are expressly incorporated by reference herein in their entireties. An initial fibrous stock suspension flow having a high consistency $Q_{H.1}$ travels via a crosswise distribution pipe 4 through a number of sectional feeding pipes $\mathbf{17}_1$–$\mathbf{17}_n$ branching off therefrom to turbulence generator 5. Modified from FIG. 2, a volume flow control may be provided in each of the sectional feeding pipes $\mathbf{17}_1$–$\mathbf{17}_n$. In order to embody a sectioned stock density control the second fibrous stock suspension flow, having a lower consistency $Q_L$, e.g., backwater-1, is guided via a crosswise distribution pipe 4.1 and sectional feeding pipes $\mathbf{18}_1$–$\mathbf{18}_n$ into the sectional feeding pipes $\mathbf{17}_1$–$\mathbf{17}_n$. Each sectional feeding pipe $\mathbf{18}_1$–$\mathbf{18}_n$ has a control valve $\mathbf{19}_1$–$\mathbf{19}_n$ in order to feed a controlled sectional fibrous stock suspension flow $Q_L$ to each of the corresponding merging points $\mathbf{20}_1$–$\mathbf{20}_n$ in which it is merged with the sectional fibrous stock suspension flow $Q_{H.1}$. A third fibrous stock suspension flow having a medium or high consistency $Q_{H.2}$ arrives at the turbulence generator 5.1 via a crosswise distribution pipe 4.2 and via a number of sectional feeding pipes $\mathbf{21}_1$–$\mathbf{21}_n$ branching off therefrom. Thus, in this embodiment of the multi-layered headbox 1.1, the possibility is created of allowing the sectional control of the throughput, the stock density, and thus the basis weight and the orientation of the fibers, in the presence of an optimal separation lamella 16.

The headbox 1 shown in FIG. 1 may naturally also be embodied as a headbox having sectioned stock density control (dilution water technology) according to the above-mentioned embodiments.

Moreover, separating lamella 16 of multi-layered headbox 1.1 is constructed of high-performance polymer 11, having essentially the above-mentioned characteristics.

One advantage of using a high-performance polymer as the lamella material lies in the avoidance of a lamella break, even in the event of an accidental failure of the headbox pump, resulting in very high pressures between the layers in the nozzle, due to the good mechanical characteristics of the high-performance polymers.

Figure 3A:
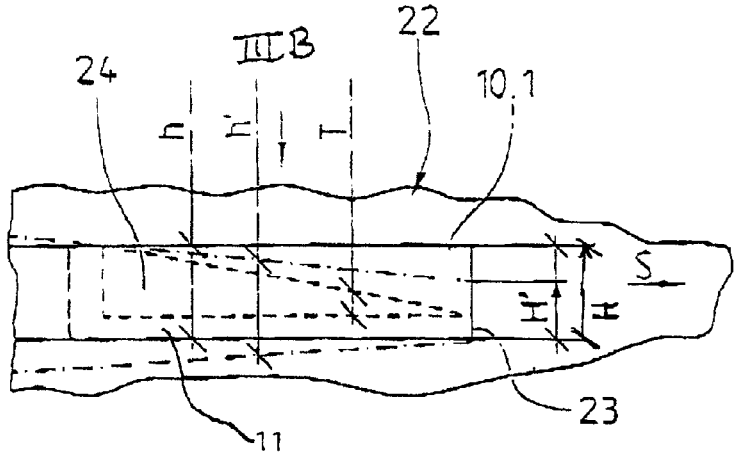
FIG. 3*a* schematically illustrates a longitudinal sectional view of an end region of a lamella according to the invention.

FIG. 3*a* shows a schematic longitudinal sectional view of an end region 22 (i.e., free end) of lamella 10.1 according to the invention.

According to the invention, lamella 10.1 is arranged to extend into a region of nozzle 7, and on its free (unmounted) end may be provided with a structure less end region 22, which provides a substantially flat (planar) surface. At the very end of end region 22, lamella 10.1 can be formed with a dull lamella end 23 having a height H of less than about 0.4 mm, preferably less than about 0.3 mm. Moreover, lamella 10.1 can be formed with a constant height h (shown in solid lines) or formed with a decreasing height h' in suspension flow direction S (shown in dot dash lines).

According to an alternative embodiment of the invention, lamella 10.1 can be arranged to extend into the region of nozzle 7, and on its free end may be provided with a structured end 22, which provides a profiled or structured surface. In this embodiment, lamella 10.1 can include a dull lamella end 23 having a height H or H' of more than about 0.5 mm in its structured free end region 22. In another embodiment, structured free end region 22 may be embodied or formed with a grooved structure 24 that is essentially rectangular and/or wedge-shaped and/or parabolic and/or essentially round with constant and/or varying depths T.

Furthermore, at least lamella end 23 may be constructed of at least one high-performance polymer 11 (dot-dashed separation line). In this regard, lamella end 23 can extend up to about 25%, and may extend up to about 50%, of a total length of lamella 10.1.

Figure 3B:
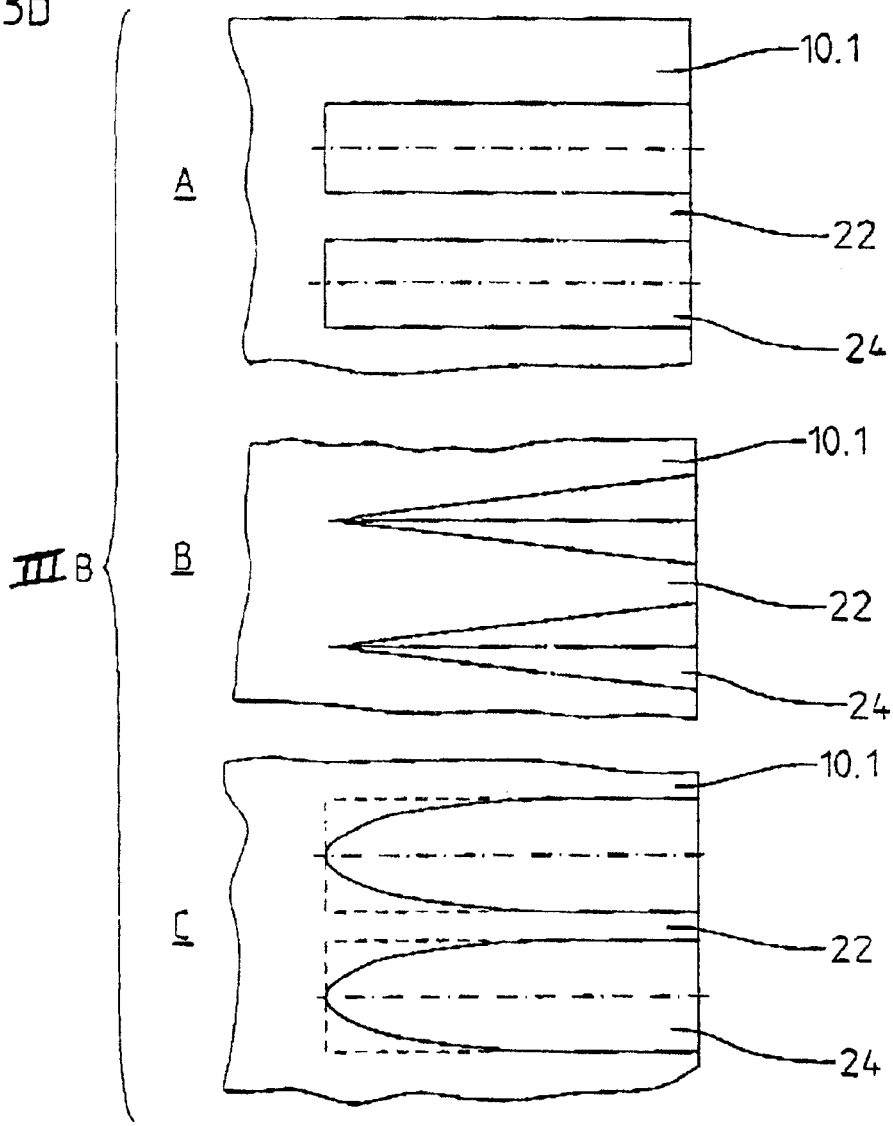
FIG. 3*b* schematically illustrates top views from a direction IIIB depicted in FIG. 3*a* of various structured end regions of lamellae according to the invention.

FIG. 3*b* schematically shows three separate top views according to view arrow IIIB in FIG. 3*a* of structured free end regions 22 of lamellae 10.1 according to the present invention.

In this regard, it is apparent that free structured end regions 22 of lamellae 10.1 according to the invention may be provided with a number of grooves 24 being essentially rectangular (A) and/or wedge-shaped (B) and/or parabolic (C) and/or essentially round with a constant and/or varying depth.

The applicant is aware of other combinations with regard to the embodiment of the free structured end region from the German Publication DE 43 29 810 A1 and U.S. Pat. No. 5,639,352, the disclosures of which are expressly incorporated by reference herein in their entireties.

In conclusion it should be stated that, according to the invention, a headbox of the type mentioned at the outset is created whose lamellae have a better expense/effectiveness ratio for all kinds of possible uses and also better withstand the different operating conditions.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein, rather, the present invention extends to all functionally equivalent structures, methods and uses, such as are within the scope of the appended claims.

List of Reference Characters

1 headbox
1.1 multi-layered headbox
2, 2.1, 2.2 feeding device
3, 3.1, 3.2 fibrous stock suspension
4, 4.1, 4.2 crosswise distribution pipe
5, 5.1 turbulence generator
5.2 turbulence pipe
6 pre-chamber
7 nozzle
8.1 lower wire
8.2 upper wire
9 gap former
10.1, 10.2 lamella
11 high-performance polymer
12.1, 12.2 end
13.1, 13.2 flow guidance wall across the width of the machine
14 separating wall
15 joint
16 separating lamella
$\mathbf{17}_1$–$\mathbf{17}_n$ sectional feeding pipe
$\mathbf{18}_1$–$\mathbf{18}_n$ sectional feeding pipe
$\mathbf{19}_1$–$\mathbf{19}_n$ control valve
$\mathbf{20}_1$–$\mathbf{20}_n$ merging point $21_1$–$21_n$ sectional feeding pipe
22 end region (free, unmounted end)
23 lamella end
24 groove
A, B, C top view
B view arrow
H height (constant)
H' height (decreasing)
h height (constant)
h' height (decreasing)
$Q_{H.1}$ initial fibrous stock suspension flow with a high consistency
$Q_{H.2}$ third fibrous stock suspension flow with a medium/high consistency
$Q_L$ second fibrous stock suspension flow with a low consistency
S flow direction
T depth
$v_s$ jet speed

What is claimed:

1. A lamella positionable in a headbox of a web production machine, said lamella being formed of at least one high-performance polymer; and said at least one high-performance polymer comprising at least one of a water absorption (DIN 53495) and a heat resistance (DIN 53461) greater than that of polysulphone (PSU), thereby resulting in a lamella formed of a material having a high stability, high heat resistance, and good to very good resistance to at least one of alkaline solution and acid.

2. The lamella in accordance with claim 1, wherein said high-performance polymer has a tensile strength $R_m$ (DIN 53455) in the range of about 50 N/mm$^2$ to about 150 N/mm$^2$, and a breaking elongation $A_s$ (DIN 53455) in the range of about 20% to about 80%.

3. The lamella in accordance with claim 2, wherein said tensile strength $R_m$ is in a range of about 70 N/mm$^2$ to about 110 N/mm$^2$, and said breaking elongation $A_s$ is in a range of about 30% to 60%.

4. The lamella in accordance with claim 1, wherein said high-performance polymer has a modulus of elasticity E (DIN 53457, ISO 527-2) in a range of about 500 N/mm$^2$ to about 10,000 N/mm$^2$.

5. The lamella in accordance with claim 4, wherein said modulus of elasticity E is in a range of about 1,000 N/mm$^2$ to about 5,000 N/mm$^2$.

6. The lamella in accordance with claim 1, wherein said high-performance polymer has an impact strength when notched (ISO 179) of about 40 kJ/m$^2$ to about 100 kJ/m$^2$.

7. The lamella in accordance with claim 6, wherein said impact strength is in a range of about 45 kJ/m$^2$ to about 90 kJ/m$^2$.

8. The lamella in accordance with claim 1, wherein said high-performance polymer has a moisture acceptance FA (ISO 62) in the range of about 0.05% to about 2%.

9. The lamella in accordance with claim 8, wherein said moisture acceptance FA is in a range of about 0.2% to about 1.2%.

10. The lamella in accordance with claim 1, wherein said high-performance polymer has a heat resistance WB (DIN 53461) in the range of about 120° C. to about 230° C.

11. The lamella in accordance with claim 10, wherein said heat resistance WB is in a range of about 170° C. to about 220° C.

12. The lamella in accordance with claim 1, wherein said high-performance polymer has a low swelling Q in a range of about 0.02% to about 0.2%.

13. The lamella in accordance with claim 12, wherein said low swelling Q is a low linear swelling $Q_L$.

14. The headbox in accordance with claim 1, wherein said high-performance polymer comprises at least one of polyphenylene sulphone (PPSU), polyether sulphone (PES), and polyetherimide (PEI).

15. The lamella in accordance with claim 1, further comprising a nozzle, and said lamella includes a free end arranged to extend to a region of said nozzle, wherein said free end comprises an structure less end region with a dull lamella end having a height less than about 0.4 mm.

16. The lamella in accordance with claim 15, wherein said height of said dull lamella end is less than about 0.3 mm.

17. The lamella in accordance with claim 1, wherein said lamella is constructed of said high-performance polymer in a homogenous structure.

18. The lamella in accordance with claim 1 in combination with a headbox with a sectioned fiber suspension density control, wherein said lamella is located within said headbox.

19. The lamella in accordance with claim 1 in combination with a headbox designed for a jet speed greater than about 1,500 m/s.

20. The lamella in combination with said headbox in accordance with claim 19, wherein the jet speed is greater than about 1,800 m/s.

21. The lamella in accordance with claim 1 in combination with a multi-layered headbox, wherein said lamella is integrated into said multi-layered headbox as a separating lamella.

22. The lamella in accordance with claim 1, wherein the web production machine comprises one of a paper, cardboard, and tissue machine.

23. A method of installing the lamella of claim 1 in a headbox of a web production machine, the method comprising:

mounting one end of the lamella within the headbox; and orienting a free end of the lamella in a flow direction.

24. A lamella positionable in a headbox of a web production machine, said lamella being formed of at least one high-performance polymer comprising a heat resistance (DIN 53461) of at least greater than 120° C., and said headbox comprising a nozzle, and said lamella includes a free end arranged to extend to a region of said nozzle, wherein said free end comprises a structured end region with a dull lamella end having a height of more than about 0.5 mm.

25. The lamella in accordance with claim 24, wherein said structured end region comprises grooves having at least one of:

(A) at least one of essentially rectangular, wedge-shaped, parabolic, and essentially round structure, and (B) varying depth.

26. The lamella in accordance with claim 24, wherein at least said lamella end is constructed of said at least one high-performance polymer.

27. The lamella in accordance with claim 17, wherein said at least one high performance polymer comprises at least one of polyphenylene sulphone (PPSU), polyether sulphone (PES), polyetherimide (PEI), and polysulphone (PSU).

28. A method of installing the lamella of claim 24 in a headbox of a web production machine, the method comprising:

mounting one end of the lamella within the headbox; and orienting the free end of the lamella in a flow direction.

29. A headbox of a web production machine comprising:

a lamella formed of at least one high-performance polymer having at least one of a water absorption (DIN 53495) and a heat resistance (DIN 53461) greater than that of polysulphone (PSU), whereby said at least one high-performance polymer results in a lamella having high stability, high heat resistance, and good to very good resistance to at least one of alkaline solution and acid.

30. The headbox in accordance with claim 29, wherein the web production machine comprises one of a paper, cardboard and tissue machine.

31. The headbox in accordance with claim 29, wherein said high-performance polymer has a tensile strength $R_m$ (DIN 53455) in the range of about 50 N/mm$^2$ to about 150 N/mm$^2$, and a breaking elongation $A_s$ (DIN 53455) in a range of about 20% to about 80%.

32. The headbox in accordance with claim 31, wherein said tensile strength $R_m$ is in a range of about 70 N/mm$^2$ to about 110 N/mm$^2$, and said breaking elongation $A_s$ is in a range of about 30% to 60%.

33. The headbox in accordance with claim 29, wherein said high-performance polymer has a modulus of elasticity E (DIN 53457, ISO 527-2) in a range of about 500 N/mm$^2$ to about 10,000 N/mm$^2$.

34. The headbox in accordance with claim 33, wherein said modulus of elasticity E is in a range of about 1,000 N/mm$^2$ to about 5,000 N/mm$^2$.

35. The headbox in accordance with claim 29, wherein said high-performance polymer has an impact strength when notched (ISO 179) of about 40 kJ/m$^2$ to about 100 kJ/m$^2$.

36. The headbox in accordance with claim 35, wherein said impact strength is in a range of about 45 kJ/m$^2$ to about 90 kJ/m$^2$.

37. The headbox in accordance with claim 29, wherein said high-performance polymer has a moisture acceptance FA (ISO 62) in the range of about 0.05% to about 2%.

38. The headbox in accordance with claim 37, wherein said moisture acceptance FA is in a range of about 0.2% to about 1.2%.

39. The headbox in accordance with claim 29, wherein said high-performance polymer has a heat resistance WB (DIN 53461) in the range of about 120° C. to about 230° C.

40. The headbox in accordance with claim 39, wherein said heat resistance WB is in a range of about 170° C. to about 220° C.

41. The headbox in accordance with claim 29, wherein said high-performance polymer has a low swelling Q in a range of about 0.02% to about 0.2%.

42. The headbox in accordance with claim 41, wherein said low swelling Q is a low linear swelling $Q_L$.

43. The headbox in accordance with claim 29, wherein said high-performance polymer comprises at least one of polyphenylene sulphone (PPSU), polyether sulphone (PES), and polyetherimide (PEI).

44. The headbox in accordance with claim 29, further comprising a jet end, and said lamella includes a free end arranged to extend to a region of said jet end, wherein said free end comprises an structure less end region with a dull lamella end having a height less than about 0.4 mm.

45. The headbox in accordance with claim 44, wherein said height of said dull lamella end is less than about 0.3 mm.

46. The headbox in accordance with claim 29, wherein said lamella is constructed of said high-performance polymer in a homogenous structure.

47. The headbox in accordance with claim 29, further comprising a sectioned stock density control.

48. The headbox in accordance with claim 6, wherein said headbox is sized for a flow speed greater than about 1,500 m/s.

49. The headbox in accordance with claim 48, wherein said flow speed is greater than about 1,800 m/s.

50. The headbox in accordance with claim 29, wherein said lamella is arranged as a separating lamella in a multi-layered headbox.

51. A method of installing a lamella in the headbox of claim 29, the method comprising:

mounting one end of the lamella within the headbox; and orienting a free end of the lamella in a flow direction.

52. A headbox comprising:

a lamella formed of at least one high-performance polymer comprising a heat resistance (DIN 53461) of at least greater than 120° C.;

a jet end, and said lamella including a free end arranged to extend to a region of said jet end, wherein said free end comprises a structured end region with a dull lamella end having a height of more than about 0.5 mm.

53. The headbox in accordance with claim 52, wherein said structured end region comprises grooves having at least one of:

(A) at least one of essentially rectangular, wedge-shaped, parabolic, and essentially round structure, and (B) varying depth.

54. The headbox in accordance with claim 52, wherein at least said lamella end is constructed of said at least one high-performance polymer.

55. The headbox in accordance with claim 52, wherein said at least one high performance polymer comprises at least one of polyphenylene sulphone (PPSU), polyether sulphone (PES), polyetherimide (PEI), and polysulphone (PSU).

56. A method of installing a lamella in the headbox of claim 52, the method comprising:

mounting one end of the lamella within the headbox; and orienting the free end of the lamella towards the jet end.

57. A lamella positionable in a headbox of a web production machine, said lamella being formed of at least one high-performance polymer; and said at least one high-performance polymer comprising one of polyphenylene sulphone (PPSU), polyether sulphone (PES), and polyetherimide (PET) and having at least one of a water absorption (DIN 53495) and a heat resistance (DIN 53461) greater than that of polysulphone (PSU), thereby resulting in a lamella formed of a material having a high stability, high heat resistance, and good to very good resistance to at least one of alkaline solution and acid.

58. A method of installing the lamella of claim 57 in a headbox of a web production machine, the method comprising:

mounting one end of the lamella within the headbox; and orienting the free end of the lamella in a flow direction.

59. A headbox of a web production machine comprising:

a lamella formed of at least one high-performance polymer comprising one of polyphenylene sulphone (PPSU), polyether sulphone (PES), and polyetherimide (PEI) and having at least one of a water absorption (DIN 53495) and a heat resistance (DIN 53461) greater than that of polysulphone (PSU), wherein said at least one high-performance polymer results in a lamella having high stability, high heat resistance, and good to very good resistance to at least one of alkaline solution and acid.

60. A method of installing a lamella in the headbox of claim 59, the method comprising:

mounting one end of the lamella within the headbox; and orienting a free end of the lamella in a flow direction.

61. A lamella positionable in a headbox of a web production machine, said lamella being formed of at least one high-performance polymer; and said at least one high-performance polymer comprising at least one of a water absorption (DIN 53495) and a heat resistance (DIN 53461) greater than that of polysulphone (PSU), thereby resulting in a lamella formed of a material having a high stability, high heat resistance, and good to very good resistance to at least one of alkaline solution and acid, wherein, in at least at a free end of the lamella, the at least one high-performance polymer is homogenous.

62. A method of installing the lamella of claim 61 in a headbox of a web production machine, the method comprising:

mounting one end of the lamella within the headbox; and orienting a free end of the lamella in a flow direction.

* * * * *